US009249770B2

(12) United States Patent
Mizuno et al.

(10) Patent No.: US 9,249,770 B2
(45) Date of Patent: Feb. 2, 2016

(54) ENGINE STARTER

(75) Inventors: Daisuke Mizuno, Chiyoda-ku (JP); Haruhiko Shimoji, Chiyoda-ku (JP); Koichiro Kamei, Chiyoda-ku (JP); Masami Abe, Chiyoda-ku (JP); Kazuhiro Odahara, Chiyoda-ku (JP); Masahiko Kurishige, Chiyoda-ku (JP); Hiroaki Kitano, Chiyoda-ku (JP); Yuhei Tsukahara, Chiyoda-ku (JP); Masahiro Iezawa, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 411 days.

(21) Appl. No.: 13/877,303

(22) PCT Filed: Jul. 27, 2011

(86) PCT No.: PCT/JP2011/067121

§ 371 (c)(1),
(2), (4) Date: Apr. 1, 2013

(87) PCT Pub. No.: WO2012/023393

PCT Pub. Date: Feb. 23, 2012

(65) Prior Publication Data

US 2013/0233128 A1 Sep. 12, 2013

(30) Foreign Application Priority Data

Aug. 20, 2010 (JP) ..... 2010-184702
Nov. 30, 2010 (JP) ..... 2010-266253
Mar. 29, 2011 (JP) ..... 2011-072078

(51) Int. Cl.
*F02N 11/00* (2006.01)
*F02N 15/06* (2006.01)

(52) U.S. Cl.
CPC ..... *F02N 11/00* (2013.01); *F02N 15/06* (2013.01); *F02N 15/067* (2013.01); *Y10T 74/137* (2015.01)

(58) Field of Classification Search
CPC ..... Y10T 74/137; F02N 11/00; F02N 15/06; F02N 15/067
See application file for complete search history.

(56) References Cited

U.S. PATENT DOCUMENTS 1,847,726 A * 3/1932 Reuter ..... 74/6
2,500,132 A * 3/1950 Miller ..... 74/6

(Continued)

FOREIGN PATENT DOCUMENTS

JP 2000-274336 A 10/2000
JP 2002-070699 A 3/2002
JP 2002-303236 A 10/2002
JP 03-328912 A 11/2003
JP 2006-132343 A 5/2006

(Continued)

OTHER PUBLICATIONS

Communication dated Feb. 3, 2015, issued by the Japanese Patent Office in counterpart Japanese application No. 2011-072078.

*Primary Examiner* — David M Fenstermacher
(74) *Attorney, Agent, or Firm* — Sughrue Mion, PLLC

(57) ABSTRACT

The engine starter includes: a starter motor; a pinion unit (30) for sliding in an axial direction on an output shaft of the starter motor; and a ring gear (100) which meshes with a pinion pushed out by a push-out mechanism (60) and receives a transmission of a rotational force of the starter motor to thereby start an engine, and the pinion portion (30) includes a pinion gear divided in the axial direction into two pinion gears which are a first pinion gear (35) having a protruded shape for synchronization, for first colliding with the ring gear upon start of meshing with the ring gear, and a second pinion gear (34) for serving to transmit the rotational force after the meshing.

17 Claims, 17 Drawing Sheets

(56) References Cited

U.S. PATENT DOCUMENTS

| | | | | | |
|---|---|---|---|---|---|
| 2,841,988 | A | * | 7/1958 | Sabatini | 74/6 |
| 2,847,857 | A | * | 8/1958 | Sabatini | 74/6 |
| 3,084,561 | A | * | 4/1963 | Mattson | 74/6 |

FOREIGN PATENT DOCUMENTS

| | | | |
|---|---|---|---|
| JP | 2009-024665 | A | 2/2009 |
| JP | 2009-168230 | A | 7/2009 |
| WO | 2010/069645 | A1 | 6/2010 |

* cited by examiner (a)

(b)

(a)

(b)

ENGINE STARTER

CROSS REFERENCE TO RELATED APPLICATIONS

This application is a National Stage of International Application No. PCT/JP2011/067121 filed Jul. 27, 2011, claiming priority based on Japanese Patent Application No. 2010-184702 filed Aug. 20, 2010, 2010-266253 filed Nov. 30, 2010 and 2011-072078 filed Mar. 29, 2011, the contents of all of which are incorporated herein by reference in their entirety.

TECHNICAL FIELD

The present invention relates to improvement of a meshing property between a pinion gear of a starter and a ring gear of an engine when the engine is started.

BACKGROUND ART

In a conventional engine starter (hereinafter referred to as starter), a start operation is carried out while an engine is stopped. Thus, a pinion gear meshes with a ring gear while the ring gear is not rotating. However, in a system for carrying out idle stop for reducing fuel consumption, a restart property is secured by meshing the pinion gear with the ring gear even when the ring gear is rotating.

For example, at the moment when the idle stop is just started and the engine is not stopped yet, if a restart is requested, or if it is necessary to reduce a period for a restart from a stop state, while the ring gear is rotating, the ring gear is meshed in advance with the pinion gear.

In this case, as a method of meshing the pinion gear with the ring gear while the ring gear is rotating, there is known a method of meshing the pinion gear by supplying an electric power to thereby adjust the speed of the starter motor of the pinion gear so that the pinion gear is synchronized with the RPM of the ring gear (for example, refer to Patent Literature 1). Moreover, there is known a method of carrying out, by providing a mechanism for synchronization in advance, synchronization up to a predetermined difference in RPM by friction of a portion of the mechanism, and then meshing gears with each other (for example, refer to Patent Literature 2). Further, there is known a method of facilitating the meshing by devising the pinion shape (for example, refer to Patent Literature 3).

CITATION LIST

Patent Literature

[PTL 1]: JP 2002-70699 A
[PTL 2]: JP 2006-132343 A
[PTL 3]: JP 2009-168230 A

SUMMARY OF INVENTION

Technical Problem

However, the prior art has the following problems.

The ring gear decelerates while rotating by inertia after the engine stops, and in this case, the RPM becomes zero while pulsating due to a fluctuation in torque caused by compression and expansion by pistons. Thus, for example, as described in Patent Literature 1, for synchronizing the RPMs of the ring gear and the pinion gear with each other by the engine starter (starter), thereby meshing them with each other, a complex configuration is necessary. Specifically, there is a need for a complex mechanism for acquiring or predicting the RPMs of the ring gear and the pinion gear, and, based thereon, for controlling the starter to mesh the ring gear and the pinion gear with each other.

Moreover, the meshing is not realized only by the synchronization and it is necessary to realize the meshing by causing the pinion gear and the ring gear to match with each other in phase. For this reason, it is necessary to recognize the precise positions in the rotation direction for the respective synchronized gears. However, in order to carry out the highly precise control, there is a need for detectors such as highly-precise encoders, and high speed arithmetic processing in an ECU on the engine side. Moreover, regarding the detection of the phase of the pinion gear by using an encoder or the like, the pinion gear itself is a moving body, which makes the attachment of the encoder thereto difficult. Accordingly, the system becomes complex and the size of the device increases.

Further, even if a complex configuration is realized by simplification by means of a method of predicting the respective RPMs to thereby enmesh the pinion gear, the RPM difference upon the contact occurs due to errors in predicted values, and a variation in timing of enmeshing the pinion gear in the axial direction. Accordingly, precise control is difficult.

On the other hand, for example, as described in Patent Literature 2, by providing a configuration in which the pinion gear and the ring gear are synchronized in RPM by a synchronizing mechanism in advance to be then brought into contact with each other, the ring gear and the pinion gear can be synchronized with each other in RPM by a simpler configuration. However, a gear ratio of the pinion gear to the ring gear is generally present at a level of ten times for reducing the size of the motor, and the pinion gear and the ring gear are not arranged coaxially due to a restriction in terms of a dimensional configuration. Thus, the synchronization is carried out while a friction surface of the synchronization mechanism for bringing the pinion gear into contact with the ring gear is always slipping, and it is difficult to realize a complete synchronization in which the phases are matched as well.

Moreover, in the synchronization mechanism, when the ring gear and the pinion gear are in contact with each other after the synchronization, except for a case where the phases are matched with each other by chance, a slip is generated between the ring gear and the pinion gear, and the ring gear and the pinion gear mesh with each other when the phases thereof are matched. In this way, in the configuration employing the synchronization mechanism, after the synchronization is realized by the slip, the pinion gear and the ring gear are brought into contact with each other. As a result, there are a problem of noises and wear upon the contact and a problem in that a friction surface is additionally necessary for the synchronization, resulting in requirement of an additional space.

Moreover, for example, in a case where the synchronization mechanism is used, as described in Patent Literature 3, in order to facilitate the meshing between the pinion gear and the ring gear, it is conceivable to devise a shape of ends of the pinion gear, thereby providing a chamfer or the like on the tooth end. As a result, according to Patent Literature 3, a space portion realized by the chamfering can be inserted, and a guiding effect by the surface contact is realized.

On this occasion, for the meshing in a state in which the ring gear is stopped, the guiding effect by the chamfering is provided. However, in a case where a relative RPM of the pinion gear is different while the ring gear is rotating, a collision of both the gears as a result of the contact of the chamfered portions generates a force component of pushing back the pinion gear in the axial direction. As a result, there is a problem in that collision sounds and a delay in meshing occur upon the meshing.

In this way, when the pinion gear is meshed while the ring gear is rotating, the noise, a decrease in service life due to wear, and the delay in starting which is caused by a loss in the meshing time occur unless more secure synchronization and phase matching are carried out at the moment of the contact.

Particularly, in a case where the RPM difference is large when the pinion gear and the ring gear mesh with each other, the teeth are rubbed against each other and the gears are meshed while generating noises. As a result, in addition to the problem of the service life caused by the wear of the teeth or the like, there is a problem in that a torque force due to the RPM difference on the chamfered surfaces and the like acts as a force in the axial direction and hence the pinion gear is bounced back significantly so that a loss is generated in the meshing time and a restart property also degrades.

The present invention has been made in order to solve those problem, and therefore has an object to obtain an engine starter for carrying out, even when the pinion gear and the ring gear mesh with each other while the ring gear is rotating, more reliable synchronization and phase matching immediately after the contact, and suppress noises, a decrease in the service life caused by wear, and a delay in the starting property which is caused by a loss of the meshing time.

Solution to Problems

According to the present invention, there is provided an engine starter, including: a starter motor; a pinion unit coupled to an output-shaft side of the starter motor by means of a spline, for sliding in an axial direction; a ring gear which has a push-out mechanism for moving the pinion unit to an engaging position with the ring gear, meshes with a pinion of the pinion unit pushed out by the push-out mechanism, and receives a transmission of a rotation force of the starter motor to thereby start an engine, in which the pinion unit includes a pinion gear divided in the axial direction into two pinion gears which are a first pinion gear having a protruded shape for synchronization, for first colliding with the ring gear upon start of meshing with the ring gear, and a second pinion gear for serving to transmit the rotation force after the meshing.

Advantageous Effects of Invention

According to the present invention, the pinion gear of the pinion unit is configured so as to be divided into the first pinion gear having the tooth shape for synchronization on the end and the second pinion gear serving to transmit the rotation force after the meshing, thereby enabling the stable meshing between the pinion gear and the ring gear even when a difference in RPM is present. Accordingly, it is possible to obtain an engine starter which carries out, even when the pinion gear is meshed while the ring gear is rotating, more reliable synchronization and phase matching at the moment of the contact and eliminates the noises, the decrease in the service life caused by wear, and the delay in the starting property caused by the time loss of the meshing time.

DESCRIPTION OF EMBODIMENTS

Figure 1:
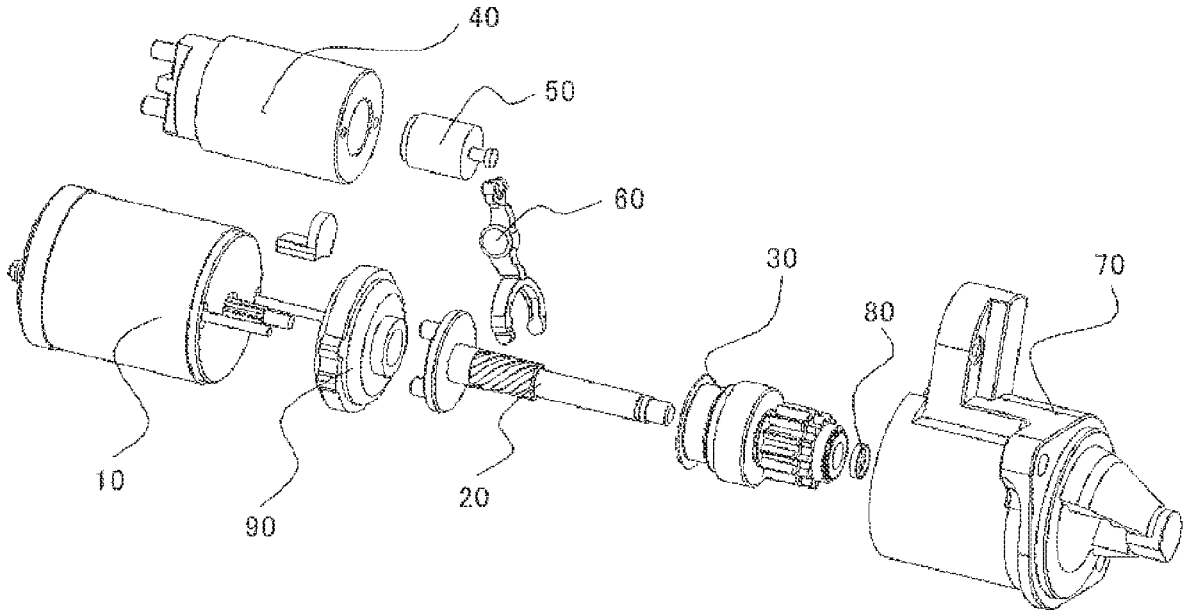
[FIG. 1] An exploded view of an engine starter according to a first embodiment of the present invention.

A description is now given of preferred embodiments of an engine starter according to the present invention referring to the drawings.

First Embodiment

FIG. 1 is an exploded view of an engine starter according to a first embodiment of the present invention. The engine starter according to the first embodiment illustrated in FIG. 1 includes a motor drive unit 10, a shaft 20, a pinion unit 30, an attraction coil unit 40, a plunger 50, a lever 60, a bracket 70, a stopper 80, and a speed reduction gear unit 90.

The motor drive unit 10 starts an engine. The shaft 20 is coupled via the speed reduction gear unit 90 to an output-shaft side of the motor. The pinion unit 30 is integrated with an overrunning clutch coupled to the shaft 20 by means of a helical spline, and can slide in the axial direction.

The attraction coil unit 40 attracts the plunger 50 by a switch being turned on. The lever 60 transmits a travel of the plunger 50 by the attraction to the pinion unit 30. The bracket 70 fixes the respective components consisting of the motor drive unit 10, the shaft 20, and the pinion unit 30 via the stopper 80 to the engine side when the pinion travels.

Figure 2:
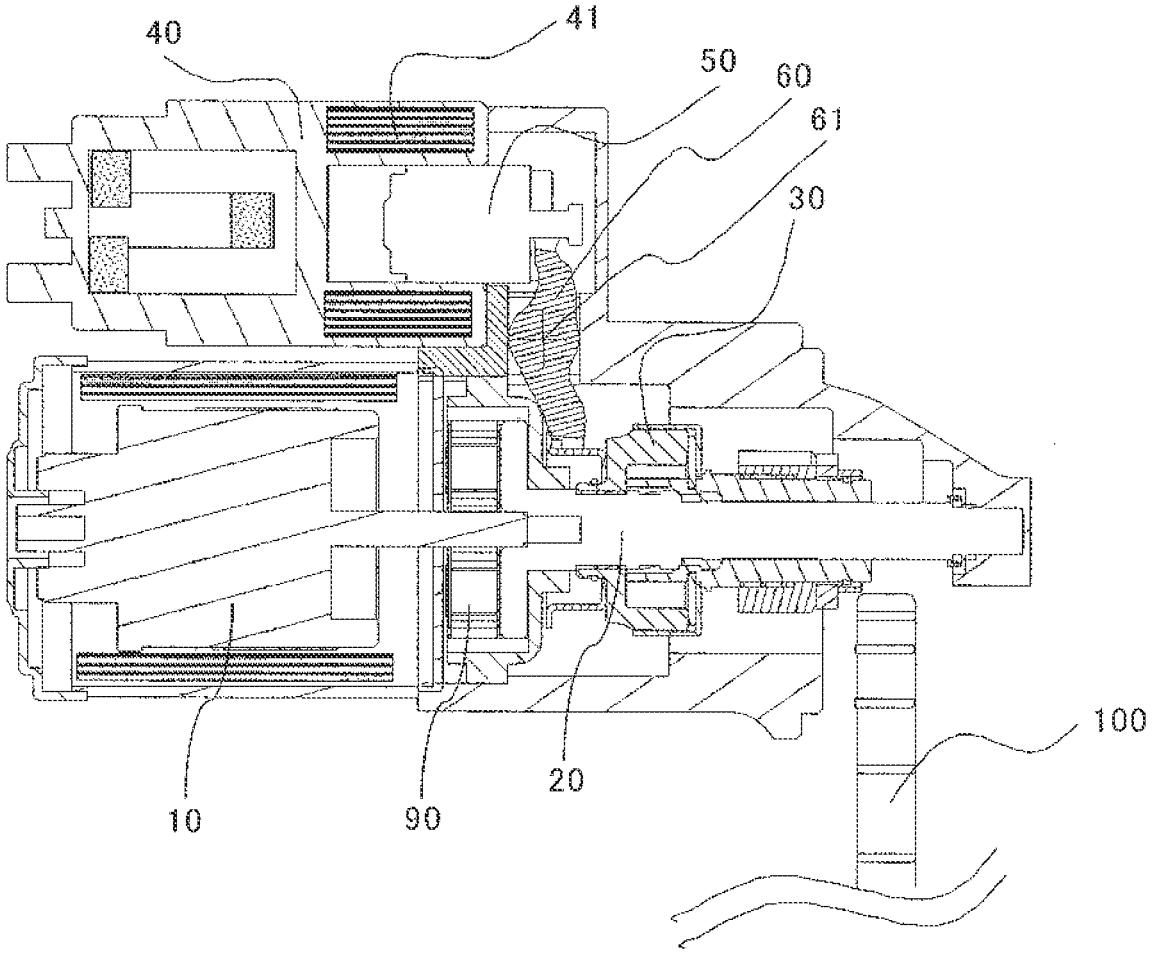
[FIG. 2] A cross sectional view when the engine starter according to the first embodiment of the present invention is installed on an engine.

FIG. 2 is a cross sectional view when the engine starter according to the first embodiment of the present invention is installed on the engine. In a case where the engine is to be started, when the switch is turned on, a relay contact closes and a current flows through an attraction coil 41 of the attraction coil unit 40. Accordingly, the plunger 50 is attracted. When the plunger 50 is attracted, the lever 60 is pulled in, and the lever 60 rotates about a lever rotation axial center 61.

In the rotated lever 60, an end portion of the opposite side of the plunger 50 pushes out the pinion unit 30 and, as a result, the pinion unit 30 is pushed out along the spline of the shaft 20 while rotating.

Figure 3:
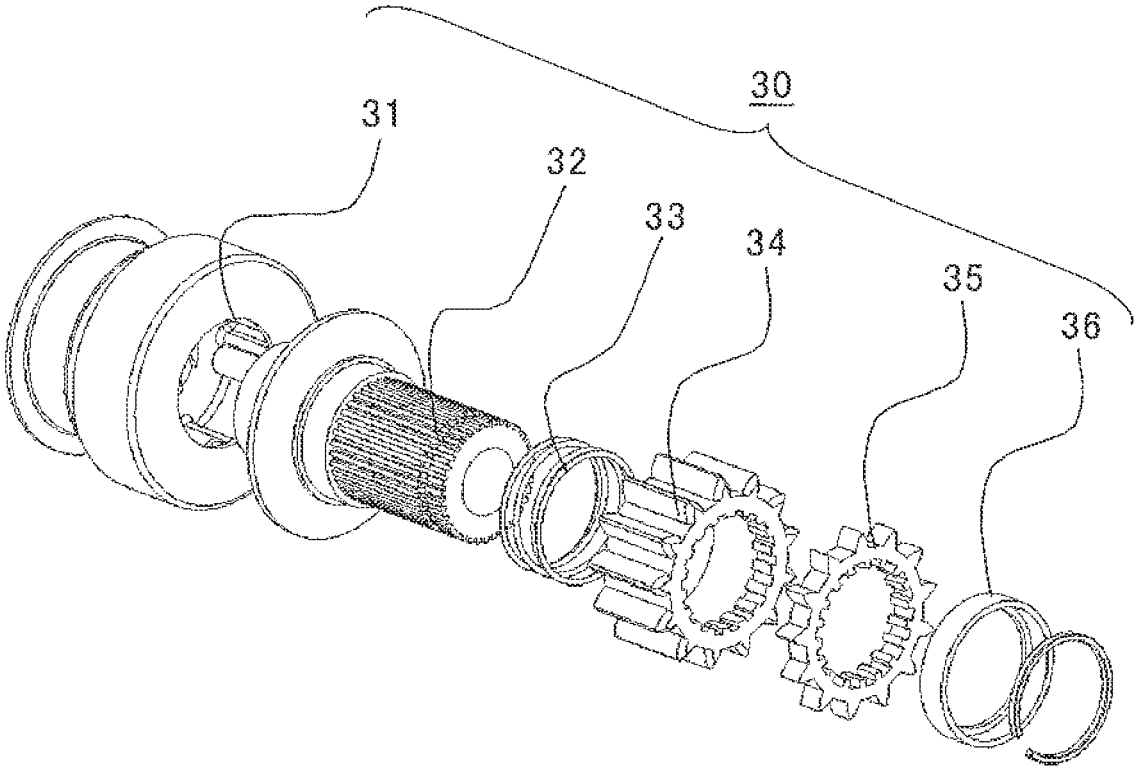
[FIG. 3] An exploded view of components of a pinion unit according to the first embodiment of the present invention.

FIG. 3 is an exploded view of components of the pinion unit 30 according to the first embodiment of the present invention. The pinion unit 30 includes an overrunning clutch 31, a shaft core 32, a coil spring 33, a second pinion gear 34, a first pinion gear 35, and a retaining component 36.

On this occasion, the pinion gear of the pinion unit 30 is divided into two pinion gears which are the second pinion gear 34 and the first pinion gear 35. The first pinion gear 35, whose detailed description is given later, has a tooth shape for synchronization on an end, and is a gear for colliding with a ring gear 100. On the other hand, the second pinion gear 34 is a gear serving to transmit a rotation force after meshing. Moreover, the first pinion gear 35 is thinner in gear thickness than the second pinion gear 34 and is thus configured to have a smaller moment of inertia.

As illustrated in FIG. 3, the coil spring 33 is arranged coaxially with the shaft core 32. Moreover, the overrunning clutch 31 is coupled to the shaft 20 by means of the helical spline. The shaft core 32 receives a transmitted torque from the overrunning clutch 31, and transmits, via grooves formed on the shaft core 32, the rotation force to the first pinion gear 35 and the second pinion gear 34.

Figure 4:
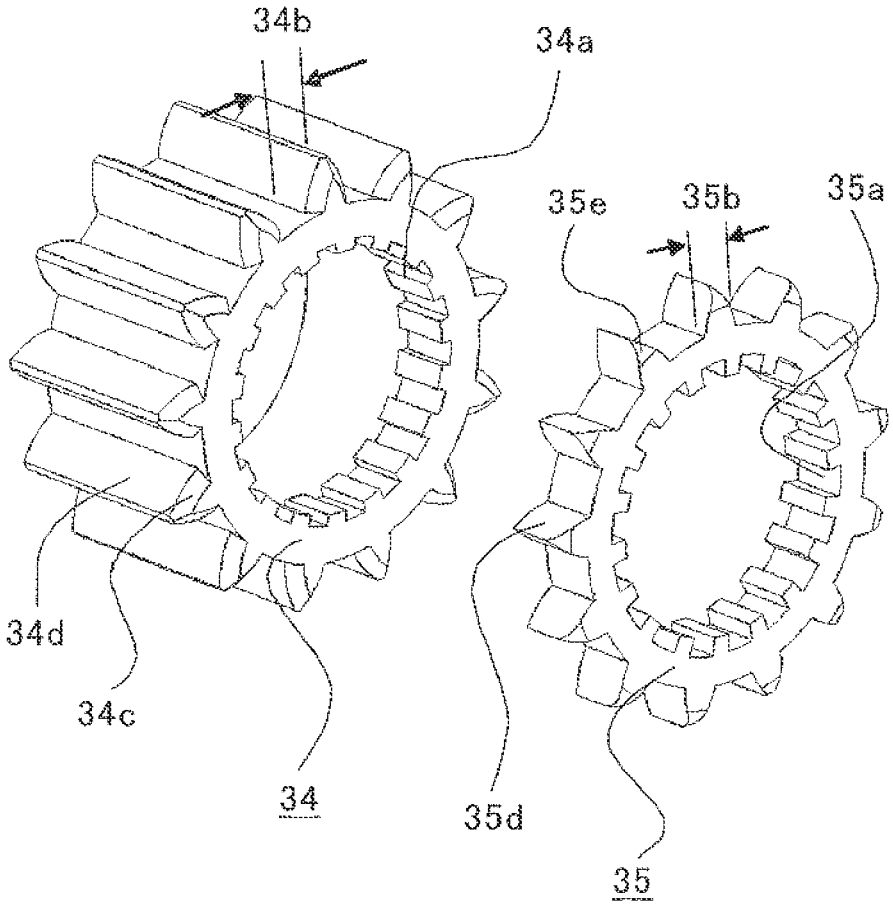
[FIG. 4] A detailed perspective view of a first pinion gear and a second pinion gear according to the first embodiment of the present invention.

FIG. 4 is a detailed perspective view of the first pinion gear 35 and the second pinion gear 34 according to the first embodiment of the present invention. On the first pinion gear 35 and the second pinion gear 34, as grooves for travel in the shaft 20 direction, a first pinion gear groove portion 35*a* and a second pinion gear groove portion 34*a* are respectively formed.

On this occasion, the second pinion gear groove portion 34*a* is formed as grooves for meshing with the grooves on the shaft core 32 with the minimum backlash. On the other hand, the first pinion gear portion 35*a* is formed so that the width and the length of the grooves are larger than those of the second pinion gear groove portion 34*a*. As a result, the first pinion gear portion 35*a* has a backlash with respect to the shaft core 32, and is thus structured so as to rotate by this backlash in the rotation direction.

Figure 5:
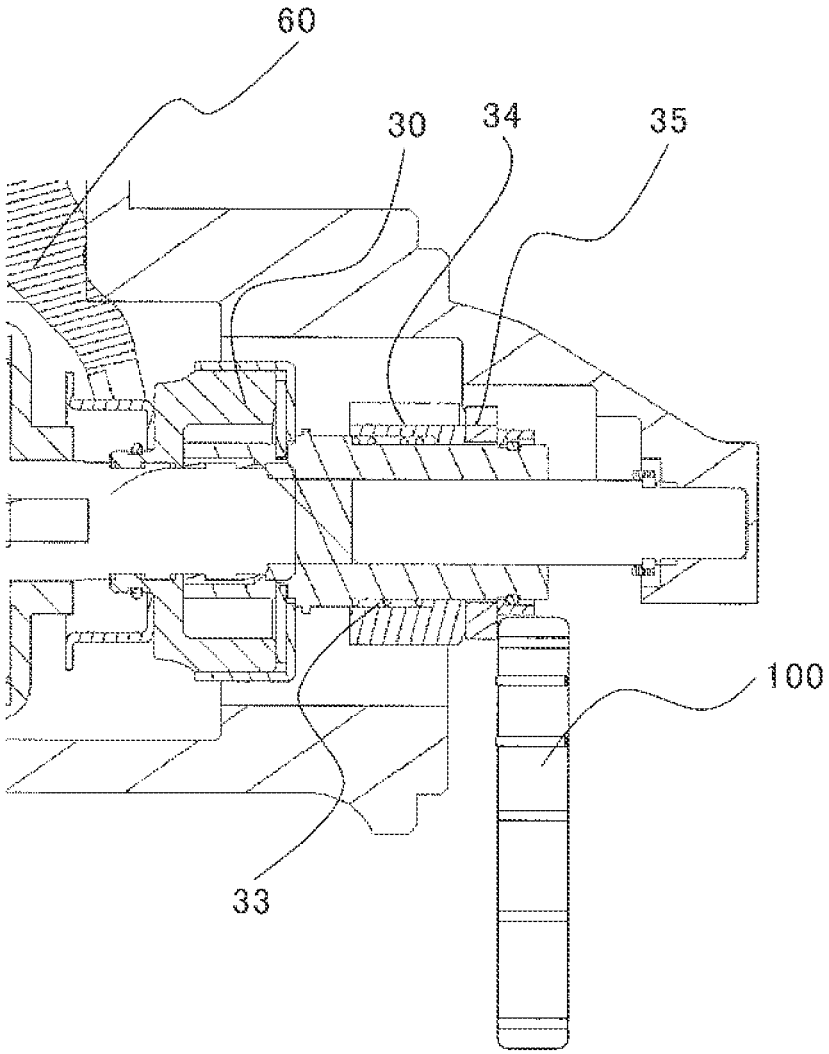
[FIG. 5] A cross sectional view of a starter portion at the moment when the first pinion gear according to the first embodiment of the present invention and a ring gear collide with each other.

FIG. 5 is a cross sectional view of a starter portion at the moment when the first pinion gear 35 according to the first embodiment of the present invention and the ring gear 100 collide with each other. In the pinion unit 30, which is pushed out, the first pinion gear 35 out of the two-part pinion gears meshes, in the first place, with the ring gear 100 while the collision is made for a displacement in the rotation direction of the meshing teeth.

Figure 6:
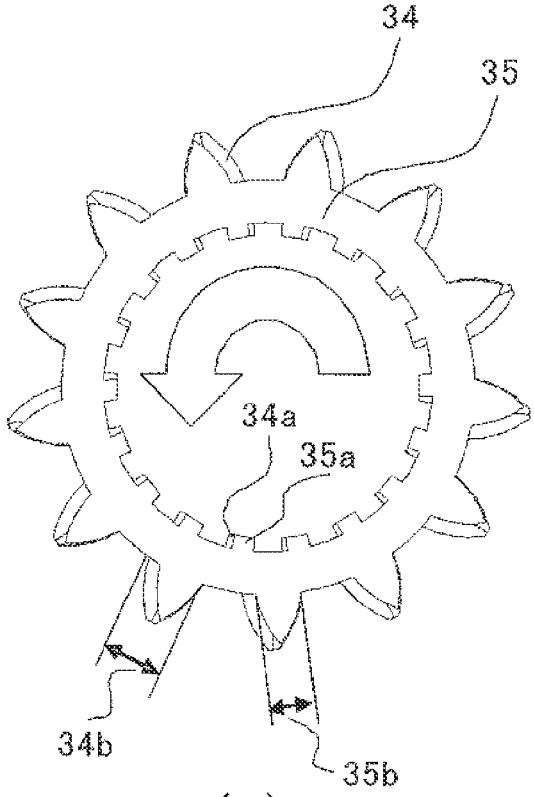
[FIG. 6] Front views illustrating positional relationships between the first pinion gear and the second pinion gear according to the first embodiment of the present invention.
Figure 6:
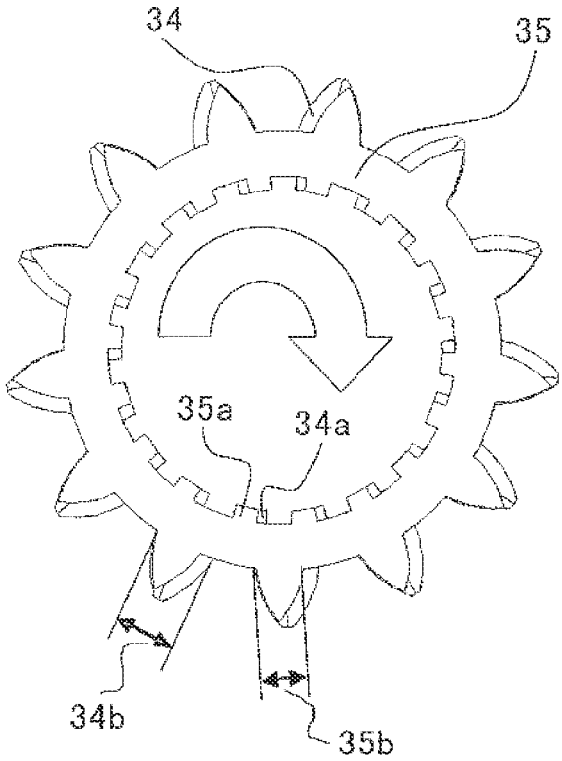

Moreover, FIG. 6 are front views illustrating positional relationships between the first pinion gear 35 and the second pinion gear 34 according to the first embodiment of the present invention. FIG. 6(*a*) illustrates a state in which, with respect to the second pinion gear 34, the first pinion gear 35 is at a position slightly rotated leftward. Moreover, FIG. 6(*b*) illustrates a state in which, with respect to the second pinion gear 34, the first pinion gear 35 is at a position slightly rotated rightward.

As illustrated in FIG. 5 described above, when the first pinion gear 35 comes in contact with the ring gear 100, as a result of a friction force in the rotation direction of a contact surface of the first pinion gear 35 with the ring gear 100, the positional relationship between the first pinion gear 35 and the second pinion gear 34 can be any one of the positional relationship of FIG. 6(*a*) and the positional relationship of FIG. 6(*b*).

In other words, the first pinion gear 35 rotationally travels by a dimension of the backlash due to the friction force of the contact portions with respect to the ring gear 100, thereby making an action of finding a phase for meshing. Particularly, the first pinion gear 35 does not have a surface generating a force component in the axial direction of the pinion other than a machined surface (corresponding to a chamfered portion 35*e*) of the tooth-tip-outer-diameter edge portion and an end surface (corresponding to a tooth surface opposite to the ring gear 100). In other words, the portions brought into contact with the ring gear 100 mainly consists of a surface contact of the end surface and chamfering is not applied to portions other than the chamfered portion 35*e*.

As a result, the first pinion gear 35 comes in contact with the ring gear 100 without being bounced back by an impulse force due to a difference in RPM. In other words, when the first pinion gear 35 and the ring gear 100 collide with each other, even if the difference in RPM is large, the pinion gear can come in contact with the ring gear without being bounced back, a loss in meshing caused by the bouncing is eliminated, and even if the difference in RPM is further large, the meshing action can be realized. Moreover, as a result of the collision between the tooth surfaces, the ring gear and the pinion gear can be synchronized.

A tooth thickness 35*b* of the first pinion gear 35 is smaller in shape than a tooth thickness 34*b* of the second pinion gear 34. As a result, the first pinion gear 35 has a larger gap with respect to the ring gear 100, and has a shape that is easily inserted into the ring gear 100, thereby improving an insertion property. Further, application of a torque load to the first pinion gear 35 can be avoided when the engine is started, and hence simplification such as a reduction in weight and size of the first pinion gear 35 can be realized.

Note that, the width of the tooth thickness 35*b* of the first pinion gear 35 rotated by the backlash between the first pinion gear groove portion 35*a* and the shaft core 32 is set so as not to exceed an area of the tooth thickness 34*b* of the second pinion gear 34. Due to the tooth thicknesses configured in this way, after the first pinion gear 35 is meshed, an action of chamfered portions 34*c*, which is described later, and the like enables the insertion of the second pinion gear 34 to be smoothly completed.

Moreover, as illustrated in FIG. 5 described above, when the first pinion gear 35 comes in contact with the ring gear 100, due to the relationship in phase between the first pinion gear 35 and the ring gear 100, a case where the first pinion gear 35 is not immediately inserted into the ring gear 100 is also conceivable. However, even in this case, the engine starter of the first embodiment can carry out more reliable synchronization and phase matching at the moment of the contact. Then, a description is given of this point referring to FIGS. 7 to 9.

Figure 7:
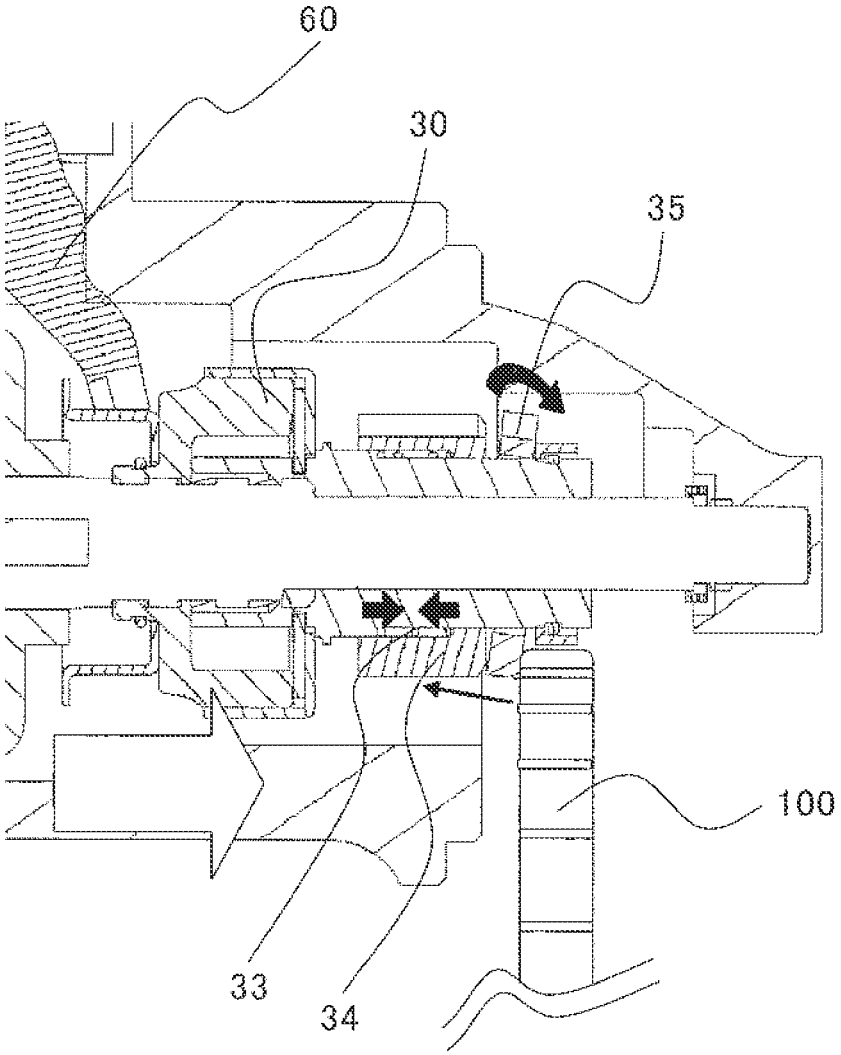
[FIG. 7] A cross sectional view of the starter portion in a state in which the first pinion gear according to the first embodiment of the present invention and the ring gear collide with each other, and consequently, the first pinion gear is inclined.
Figure 8:
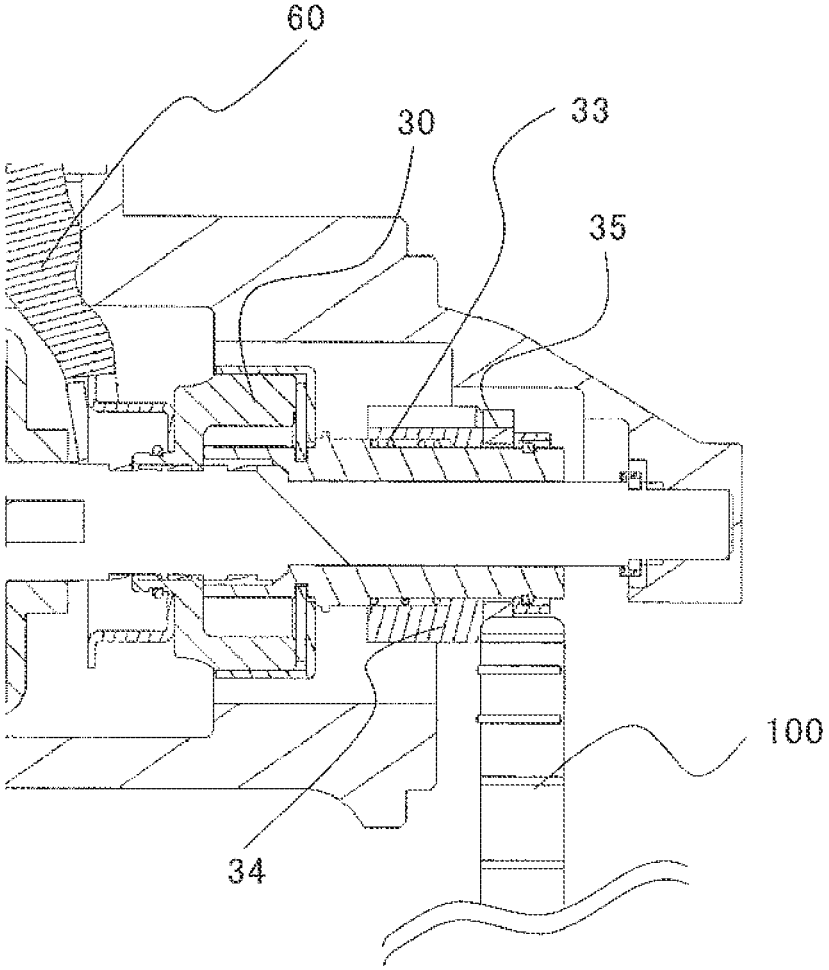
[FIG. 8] A cross sectional view of the starter portion according to the first embodiment of the present invention in a state in which, after the state of FIG. 7, the ring gear is inserted into the first pinion gear, and is in contact with the second pinion gear.
Figure 9:
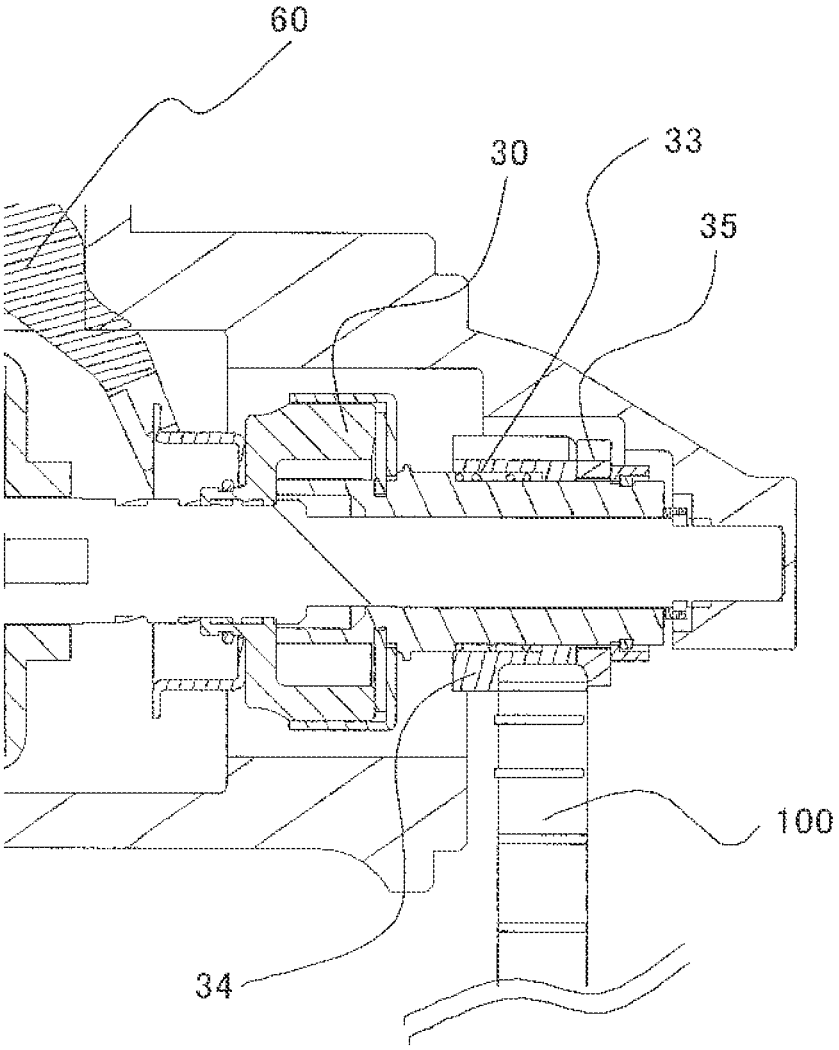
[FIG. 9] A cross sectional view of the starter portion according to the first embodiment of the present invention in a state in which, after the state of FIG. 7 and the state of FIG. 8, the ring gear is inserted into the first pinion gear and the second pinion gear, and is in a meshed state.

FIG. 7 is a cross sectional view of the starter portion in a state in which the first pinion gear 35 according to the first embodiment of the present invention and the ring gear 100 collide with each other, and consequently, the first pinion gear 35 is inclined. Moreover, FIG. 8 is a cross sectional view of the starter portion according to the first embodiment of the present invention in a state in which, after the state of FIG. 7, the ring gear 100 is inserted into the first pinion gear 35, and is in contact with the second pinion gear 34. Further, FIG. 9 is a cross sectional view of the starter portion according to the first embodiment of the present invention in a state in which, after the state of FIG. 7 and the state of FIG. 8, the ring gear 100 is inserted into the first pinion gear 35 and the second pinion gear 34, and is in the meshing state.

As illustrated in FIG. 7, in a case where, due to the relationship in phase, the first pinion gear 35 is not immediately inserted into the ring gear 100, upon the contact, the first pinion gear 35 is pressed against the ring gear 100 and is thus inclined. On this occasion, a state in which the coil spring 33 presses, via the second pinion gear 34, the first pinion gear 35 against the ring gear 100 while the coil spring 33 is being contracted, is brought about.

On this occasion, as described above referring to FIG. 4, the first pinion gear groove portion 35*a* is formed larger in the width direction and the depth direction of the groove than the second pinion gear groove portion 34*a*, and the first pinion gear portion 35*a* has backlashes, with respect to the shaft core 32, in the rotation direction and the radial direction. As a result, in a case where, due to the relationship in phase, the first pinion gear 35 is not immediately inserted into the ring gear 100, the groove diameter of the first pinion gear 35 has the backlashes in the gear rotation direction as well as the gear radial direction. In this way, as illustrated in FIG. 7, the first pinion gear 35 has the backlash also in the gear radial direction, and can thus tilt.

Further, on a tooth tip diameter portion of the first pinion gear 35, which is to come in contact with the ring gear 100, the chamfered portion 35*e* having an angle R is provided (see FIG. 4). Then, when the ring gear 100 rotates and the first pinion gear 35 is in a phase state that is ready for the insertion into a next tooth of the ring gear 100, due to a friction damper effect between the second pinion gear 34 and the shaft core 32, the first pinion gear 35 is inserted, as illustrated in FIG. 8 described above, by an action in which the first pinion gear 35 recovers from the tilted state while the first pinion gear 35 is in contact with the ring gear 100.

In other words, by providing the groove diameter of the first pinion gear 35 with the backlashes in the gear rotation direction as well as in the gear radial direction, the first pinion gear 35 in contact with the ring gear 100 can carry out, by means of the friction damper effect of the second pinion gear 34, the action of finding the gap of the ring gear 100 and can also relatively increase the range of inserting the first pinion gear 35 into the gap of the ring gear 100.

As a result, the first pinion gear 35 is inserted, without being bounced back by the ring gear 100, between the neighboring teeth of the ring gear 100 by the action of recovery from the tilting, and can synchronize the rotations by the contact between the tooth surfaces.

The colliding surfaces upon the insertion are a tooth surface 35*d* of the first pinion gear 35 and the ring gear 100, and even if there is a difference in RPM, the collision is made in the rotation direction, resulting in the synchronization of the rotation by a torque thereof. Particularly, when the RPM of the ring gear 100 is higher, the synchronization is made by bringing the tooth surface of the first pinion gear 35 into contact, and the clutch rotates idly by the overrunning clutch 31. Accordingly, an impact thereof is caused only by the mass of the first pinion gear 35, resulting in a small impact and low noise.

The pinion unit 30, which has synchronized in this way, transitions, as illustrated in FIG. 8 described above, by further being pushed, to a state in which the ring gear 100 and the second pinion gear 34 collide with each other. On this occasion, as illustrated in FIG. 4 described above, on the both sides of a tooth surface edge portion on the first pinion gear 35 side of the second pinion gear 34, the chamfered portions 34*c* illustrated in FIG. 4 described above are provided. Thus, as illustrated in FIG. 9, the second pinion gear 34 and the ring gear 100 are guided by the chamfered portions 34*c* to mesh with each other.

On this occasion, the chamfered portions 34*c* have a component of axially pushing back, but the pinion unit 30 and the ring gear 100 are synchronized by the first pinion gear 35, resulting in no problem. Moreover, the presence of the chamfered portions 34*c* enables the insertion of the ring gear 100 to the second pinion gear 34 to be smoothly completed regardless of the relative rotation direction between the pinion gear and the ring gear 100.

Thus, as a result of a series of the operations illustrated in FIGS. 7 to 9, after the first pinion gear 35 meshes to synchronize with the ring gear 100, the second pinion gear 34 meshes with the ring gear 100, thereby starting the engine. Then, after the second pinion gear 34 and the ring gear 100 mesh with each other, the torque transmission between the pinion unit 30 and the ring gear 100 is carried out only between the tooth surfaces 34*d* of the second pinion gear and the ring gear 100. As a result, by properly designing the second pinion gear 34, the transmission loss can be suppressed.

Thus, a relationship of gears between the second pinion gear 34 and the ring gear 100 determines a tooth hit sound, which causes a cranking sound upon the engine start, and the like. Therefore, even if the first pinion gear 35 is formed to have the teeth having a small tooth thickness and thus having a large backlash, no problem occurs. In other words, even if specifications of the teeth of the first pinion gear 35 are changed in profile shift, tooth tip outer diameter, or pressure angle compared with specifications of the teeth of the second pinion gear 34, to thereby increase the backlash with respect to the ring gear 100, no problem occurs.

As described above, according to the first embodiment, even if there is a difference in RPM between the ring gear and the pinion unit, by employing the pinion gear having the configuration as described above, which is divided into the first pinion gear having the tooth shape for synchronization at the end and the second pinion gear serving to transmit the rotation force after the meshing, the action corresponding to one tooth enables the instantaneous meshing. As a result, the insertion property between the ring gear and the pinion unit can be improved and the service life of the tooth shape can be extended against the wear on the end surface. Further, the suppression of the noise and the suppression of the transmission loss can be realized.

For example, even in a case where the RPM of the ring gear is higher by 500 than that of the pinion gear, it is verified that the pinion gear instantaneously meshes without being bounced back, and the noise level at the moment of the meshing decreases to a 5 dB level. Thus, by employing the pinion unit having the configuration of this application, and carrying out the enmeshing action at an idling RPM level, the pinion gear and the ring gear can be stably meshed with each other, resulting in relief of restrictions on the control and a reduction in time in terms of the restart property.

Figure 10:
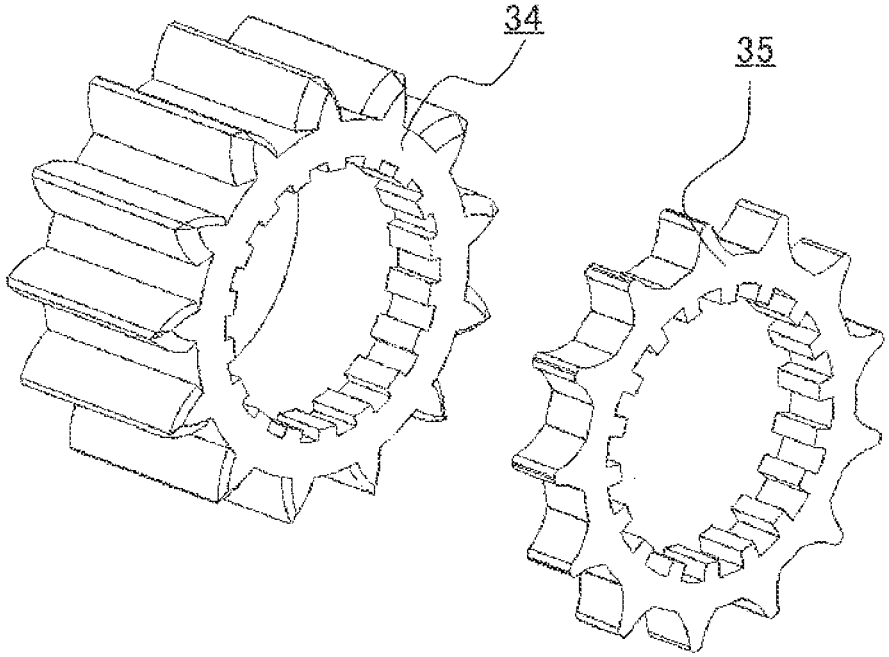
[FIG. 10] A perspective view of the first pinion gear constituted by protrusions according to the first embodiment of the present invention.

On this occasion, the first pinion gear is not limited to the case where the first pinion gear has the tooth shape illustrated in FIG. 4 described above, for example. FIG. 10 is a perspective view of the first pinion gear constituted by protrusions according to the first embodiment of the present invention. As illustrated in FIG. 10, in a case where the first pinion gear has a wave shape having as many protrusions as the teeth, no problem occurs.

Moreover, with respect to the mechanism for pushing out the pinion unit, a description has been given of the case where the pulling force by the plunger is transmitted to the lever to thereby push out the pinion unit, but the mechanism is not limited to this case. As the method of pushing out the pinion unit, other power sources such as a motor torque may be used.

Second Embodiment

According to a second embodiment of the present invention, regarding the backlashes of a first pinion gear 35 and a second pinion gear 34, a description is given of a structure of a pinion unit which can further suppress the wear by providing eccentricity in phase.

The configuration of an engine starter according to the second embodiment is the same as in FIG. 1 according to the first embodiment described above, and the engine starter includes a motor drive unit 10, a shaft 20, a pinion unit 30, an attraction coil unit 40, a plunger 50, a lever 60, a bracket 70, a stopper 80, and a speed reduction gear unit 90, and the pinion unit 30 is pushed out while rotating.

Figure 11:
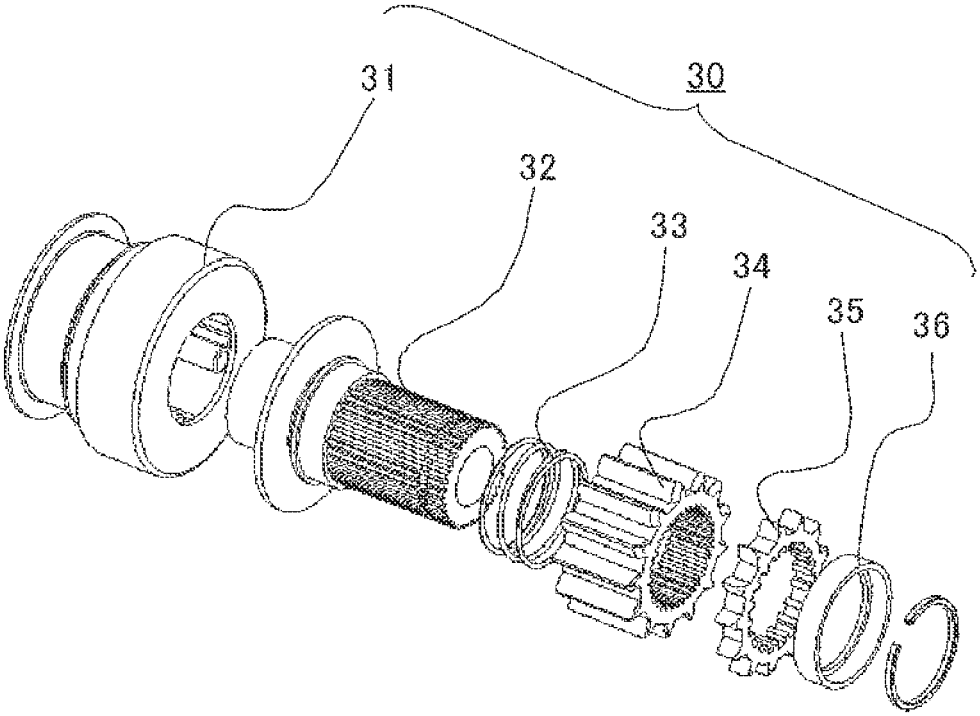
[FIG. 11] An exploded view of components of a pinion unit according to a second embodiment of the present invention.

FIG. 11 is an exploded view of components of the pinion unit 30 according to the second embodiment of the present invention. The pinion unit 30 includes an overrunning clutch 31, a shaft core 32, a coil spring 33, the second pinion gear 34, the first pinion gear 35, and a retaining component 36. On this occasion, the components of the pinion gear of the pinion unit 30 serve as in the first embodiment described above, and a detailed description thereof is therefore omitted.

Figure 12:
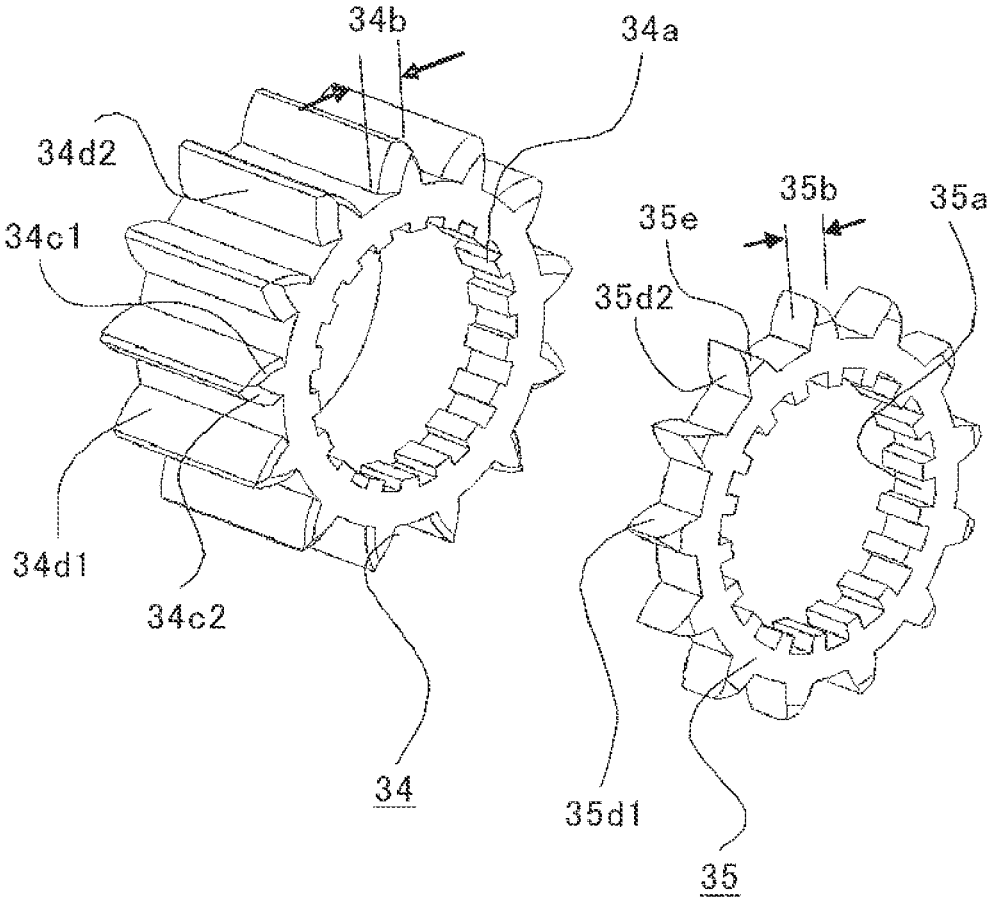
[FIG. 12] A detailed perspective view of a first pinion gear and a second pinion gear according to the second embodiment of the present invention.

FIG. 12 is a detailed perspective view of the first pinion gear 35 and the second pinion gear 34 according to the second embodiment of the present invention. On the first pinion gear 35 and the second pinion gear 34, as grooves for travel in the shaft 20 direction, a first pinion gear groove portion 35*a* and a second pinion gear groove portion 34*a* are respectively formed.

On this occasion, the second pinion gear groove portion 34*a* is formed as grooves for meshing with the grooves on the shaft core 32 with the minimum backlash. On the other hand, the first pinion gear portion 35*a* is formed so that the width and the length of the grooves are larger than those of the second pinion gear groove portion 34*a*. As a result, the first pinion gear portion 35*a* has a backlash with respect to the shaft core 32, and is thus structured so as to rotate by this backlash in the rotation direction.

Figure 13:
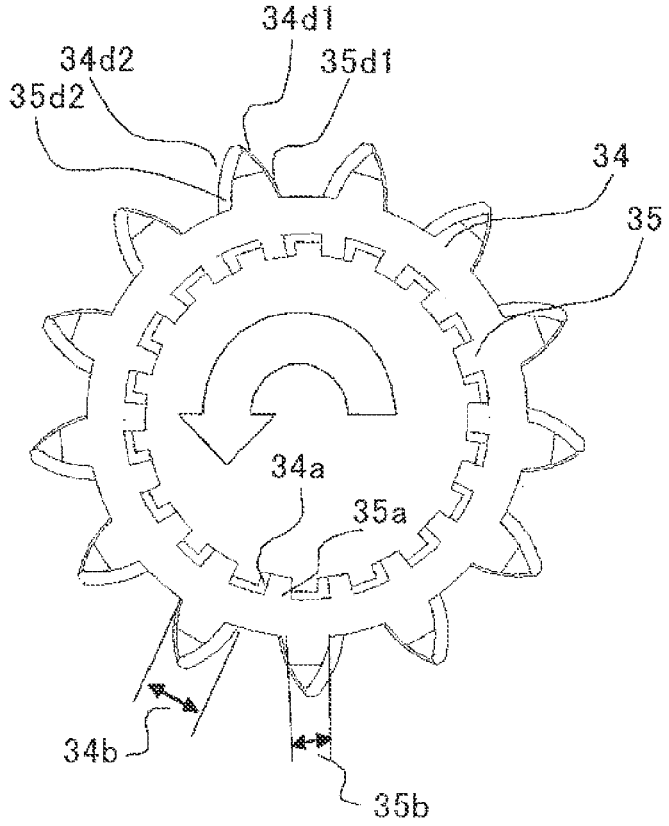
[FIG. 13] Front views illustrating positional relationships between the first pinion gear and the second pinion gear according to the second embodiment of the present invention.
Figure 13:
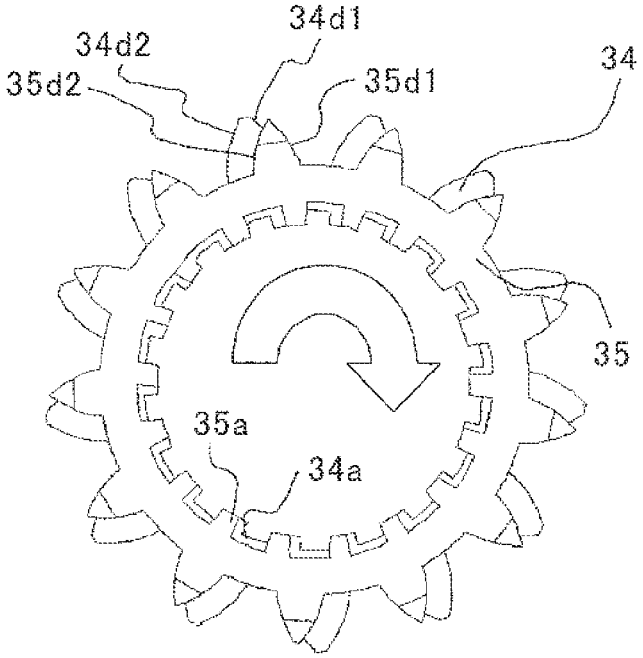

On this occasion, the backlash according to the second embodiment is eccentric in phase in a relationship between the first pinion gear 35 and the second pinion gear 34. A description is now given of the eccentricity referring to the drawings. FIG. 13 are front views illustrating positional relationships between the first pinion gear and the second pinion gear according to the second embodiment of the present invention.

The eccentricity is made in the surface direction (corresponding to the left rotation direction and the right rotation direction of FIG. 13) for the pinion to transmit, by means of the rotation of the motor, the torque to the ring gear 100. In other words, as illustrated in FIG. 6, according to the first embodiment described above, with respect to the tooth thickness of the first pinion gear 35, extruded quantities of the tooth thickness of the second pinion gear 34 are the same in the both cases of FIGS. 6(*a*) and 6(*b*). In contrast, according to the second embodiment, an extruded quantity illustrated in FIG. 13(*a*) and an extruded quantity illustrated in FIG. 13(*b*) are different from each other, and this situation is expressed as "eccentric in the surface direction for transmitting the torque."

A detailed description is now given referring to FIGS. 13(*a*) and 13(*b*). FIG. 13(*a*) illustrates a state in which the pinion rotates in the direction for transmitting the torque and the first pinion gear 35 is displaced by the backlash in a direction represented by an arrow. During the torque transmission, on the transmission surface side of the pinion gear, a surface 35*d*1 of the first pinion gear is more recessed than a second pinion gear surface 34*d*1, and a state in which the torque cannot be transmitted by the first pinion gear 35 is thus brought about.

Moreover, FIG. 13(*b*) illustrates a state in which the rotation speed of the ring gear 100 is high, and the backlash of the first pinion gear 35 is displaced in a direction represented by an arrow. This state only occurs when the second pinion gear 34 is not meshed with the ring gear 100 and only the first pinion gear 35 meshes with the ring gear 100.

A state until the first pinion gear 35 meshes and synchronizes with the ring gear 100 is the same as in the first embodiment described above. Then, in this state, influence of the meshing property caused by the eccentricity is not relevant.

Then, the pinion gear after the first pinion gear 35 has meshed and synchronized, is brought into the state of FIG. 8 according to the first embodiment described above by the further pushing, and the state transitions to the state in which the ring gear 100 and the second pinion gear 34 collide with each other. In other words, it is conceivable that, in the state of FIG. 13(*a*) or FIG. 13(*b*), the second pinion gear 34 collides with the ring gear 100.

On this occasion, on the tooth surface edge portion on the first pinion gear 35 side of the second pinion gear 34, two chamfers including a motor torque transmission surface side chamfered portion 34*c*1 and a motor torque non-transmission surface side chamfered portion 34*c*2 are made (see FIG. 12). Then, in the state of FIG. 13(*a*), when the ring gear 100 collides with the chamfer 34*c*1, a step to the torque transmission surface side of the second pinion gear 34 is small due to the eccentricity and the meshing of the second gear 34 with the ring gear 100 is facilitated.

On the other hand, in the state of FIG. 13(*b*), when the chamfer 34*c*2 on the edge portion on the opposite side of the torque transmission surface collides with the ring gear 100, the pinion rotates idly by means of the one-way clutch and hence the scratching force on the surface is small. Accordingly, the large step does not pose a problem. In other words, the eccentricity reduces the step to the surface on the side on which the friction force by the collision between the pinion side chamfered portion and the ring gear 100 is increased, and hence it is possible to minimize the friction.

Thus, as in the second embodiment, in a case where the first pinion gear 35 and the second pinion gear 34 are eccentric to each other, the chamfer 34*c*1 on the tooth surface on the side of the surface on which the torque is transmitted by the pinion and the chamfer 34*c*2 on the opposite side are different in size. Further, the sizes are determined by the area hidden by the backlash of the first pinion gear 35.

Further, the ring gear 100 is synchronized with the first pinion gear 35 and is different in phase at the moment of the contact with the second pinion gear 34. Thus, by forming the chamfer 34*c*1 on the torque transmission surface side of the second pinion gear 34 into an involute chamfer, a chamfer along the rotation of the pinion is realized and the friction can be further suppressed.

As described above, according to the second embodiment, the backlash between the first pinion gear and the second pinion gear are provided so as to be eccentric in phase. As a result, during the pushing for the phase matching between the second pinion gear and the first pinion gear, the second pinion gear is smoothly pushed in, and hence a problem such as the friction is eliminated. Thus, in the meshing of the ring gear respectively with the first pinion gear and the second pinion gear, even if there are differences in RPM, the smooth meshing can be realized. As a result, the wear can be minimized in addition to the relief of the restriction on the control, the reduction in time in terms of the restart property, and the reduction of the noise.

Third Embodiment

According to a third embodiment, a description is given of a structure, with which it is possible to increase a damper effect, regarding the action mechanism in the axial direction of a first pinion gear 35 and a second pinion gear 34, by providing the friction force of the first pinion gear 35 on a portion different from the shaft core.

The configuration of an engine starter according to the third embodiment is the same as in FIG. 1 according to the first embodiment described above, and the engine starter includes a motor drive unit 10, a shaft 20, a pinion unit 30, an attraction coil unit 40, a plunger 50, a lever 60, a bracket 70, a stopper 80, and a speed reduction gear unit 90, and a pinion unit 30 is pushed out while rotating.

Figure 14:
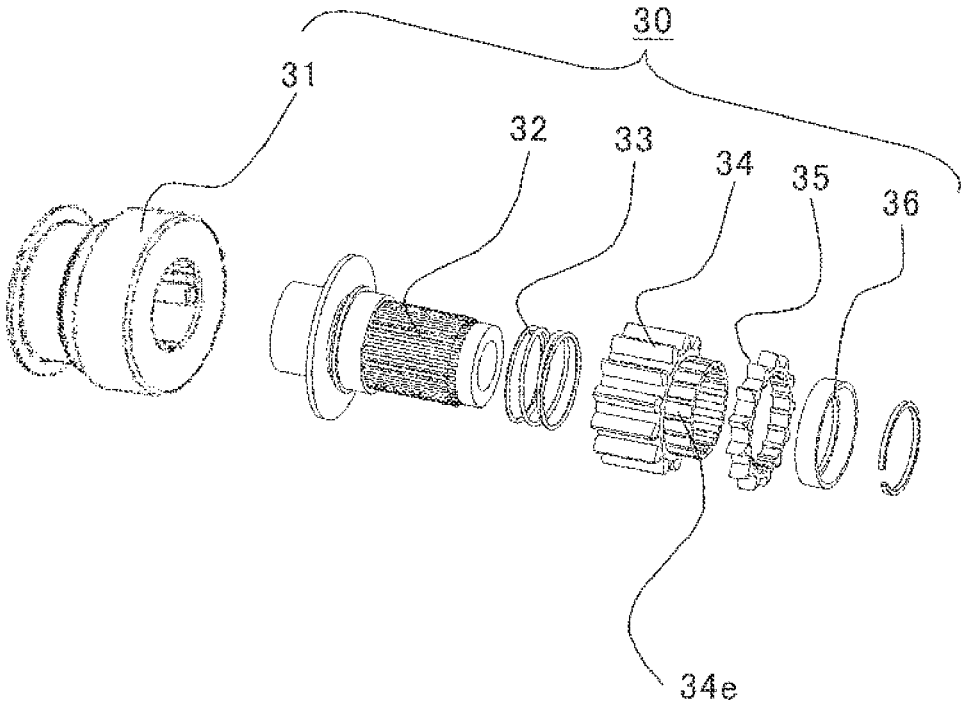
[FIG. 14] An exploded view of components of a pinion unit according to a third embodiment of the present invention.

FIG. 14 is an exploded view of components of the pinion unit 30 according to the third embodiment of the present invention. The pinion unit 30 includes an overrunning clutch 31, a shaft core 32, a coil spring 33, the second pinion gear 34, the first pinion gear 35, and a retaining component 36. On this occasion, the fundamental components of the pinion gear of the pinion unit 30 serve as in the first embodiment described above, and a detailed description thereof is therefore omitted.

Compared with the first embodiment described above, according to the third embodiment of the present invention, shapes of the first pinion gear 35, the second pinion gear 34, and the shaft core 32 are different. A description therefore is now mainly given of these differences. The second pinion gear 34 includes a protrusion (hereinafter referred to as grooved protrusion 34*e*) toward the first pinion gear 35, the protrusion having grooves formed between the grooves for the shaft core 32 and the tooth surface of the second pinion gear 34. The first pinion gear 35 meshes with the grooves formed on the grooved protrusion 34*e* at a groove portion 35*a* of the first pinion gear.

According to the third embodiment, the groove portion 35*a* of the first pinion gear and a groove portion 34*a* of the second pinion gear mesh with different grooves. Thus, the groove portion 35*a* of the first pinion gear includes grooves which do not transmit a torque and hence the number of the teeth can be reduced in setting the number of the grooves. Accordingly, the meshing shape of the grooved protrusion 34*e* of the second pinion gear can be formed into a shape independent of the groove shape of the shaft core 32.

It is necessary for a sum of the friction force in the axial direction of the first pinion gear 35 and the second pinion gear 34 and the load which compresses the coil spring 33 to the maximum stroke not to exceed the load pushing out the pinion.

As described above, according to the third embodiment, regarding the action mechanism in the axial direction of the first pinion gear and the second pinion gear, the friction force of the first pinion gear can be provided on the portion different from the shaft core. In other words, the first pinion gear is configured so as to axially travel independently of the pinion unit. As a result, with respect to a dumper function by the friction force for the axial travel by the spring, it is possible to increase only the portion of the first pinion gear 35.

Fourth Embodiment

According to the third embodiment described above, a description is given of the structure for, regarding the action mechanism in the axial direction of the first pinion gear 35 and the second pinion gear 34, increasing the damper effect. In contrast, according to a fourth embodiment, regarding the action mechanism in the rotation direction of a first pinion gear 35 and a second pinion gear 34, a description is given of a structure with which it is possible to increase the friction force in the rotation direction between the first pinion gear 35 and a ring gear 100 so as to be larger than the friction force in the rotation direction between the first pinion gear 35 and the second pinion gear 34 when the friction coefficient between each of the pinion gears 34 and 35 and the ring gear 100 is small.

The configuration of an engine starter according to the fourth embodiment is the same as in FIG. 1 according to the first embodiment described above, and the engine starter includes a motor drive unit 10, a shaft 20, a pinion unit 30, an attraction coil unit 40, a plunger 50, a lever 60, a bracket 70, a stopper 80, and a speed reduction gear unit 90, and a pinion unit 30 is pushed out while rotating.

Figure 15:
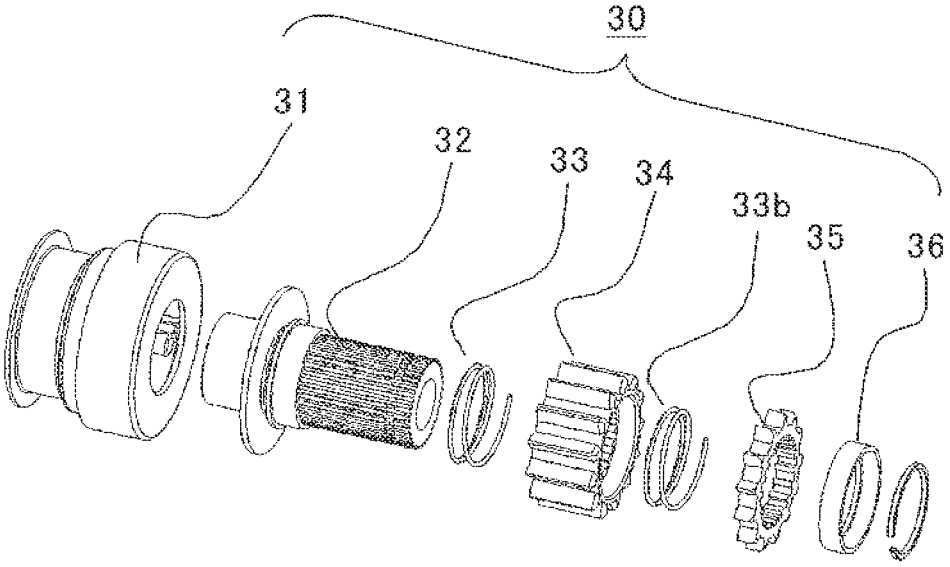
[FIG. 15] An exploded view of components of a pinion unit according to a fourth embodiment of the present invention.

FIG. 15 is an exploded view of components of the pinion unit 30 according to the fourth embodiment of the present invention. The pinion unit 30 includes an overrunning clutch 31, a shaft core 32, a coil spring 33, a coil spring 33*b*, the second pinion gear 34, the first pinion gear 35, and a retaining component 36. On this occasion, the fundamental components of the pinion gear of the pinion unit 30 serve as in the first embodiment described above, and a detailed description thereof is therefore omitted.

Compared with the first embodiment described above, the fourth embodiment according to the present invention is different in that the coil spring is divided into two portions (coil springs 33 and 33*b*). A description therefore is now mainly given of the difference.

Figure 16:
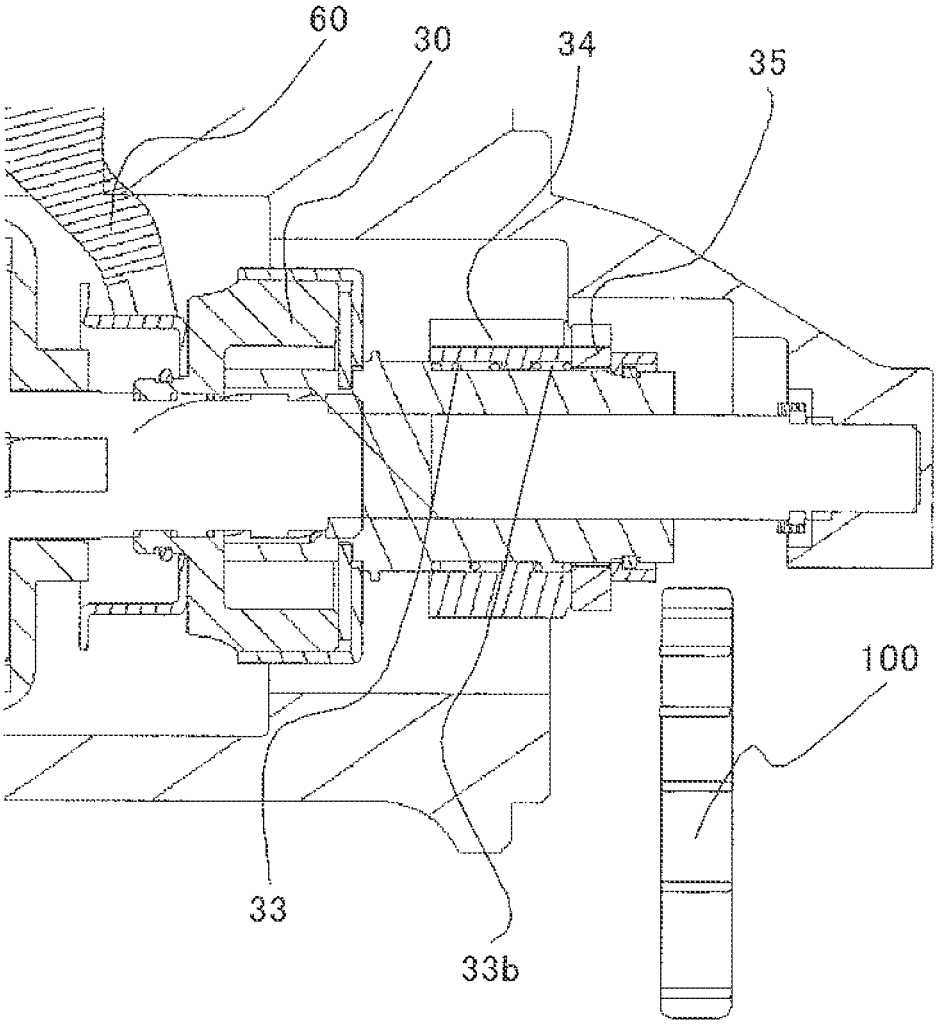
[FIG. 16] A cross sectional view of a starter portion before a first pinion gear according to the fourth embodiment of the present invention collides with a ring gear.

FIG. 16 is a cross sectional view of the starter portion before the first pinion gear 35 according to the fourth embodiment of the present invention and the ring gear 100 collide with each other. According to the fourth embodiment, independently of the coil spring 33 pushing the second pinion gear 34 toward the pushing direction of the shaft, the coil spring 33*b* exists between the first pinion gear 35 and the second pinion gear 34.

Figure 17:
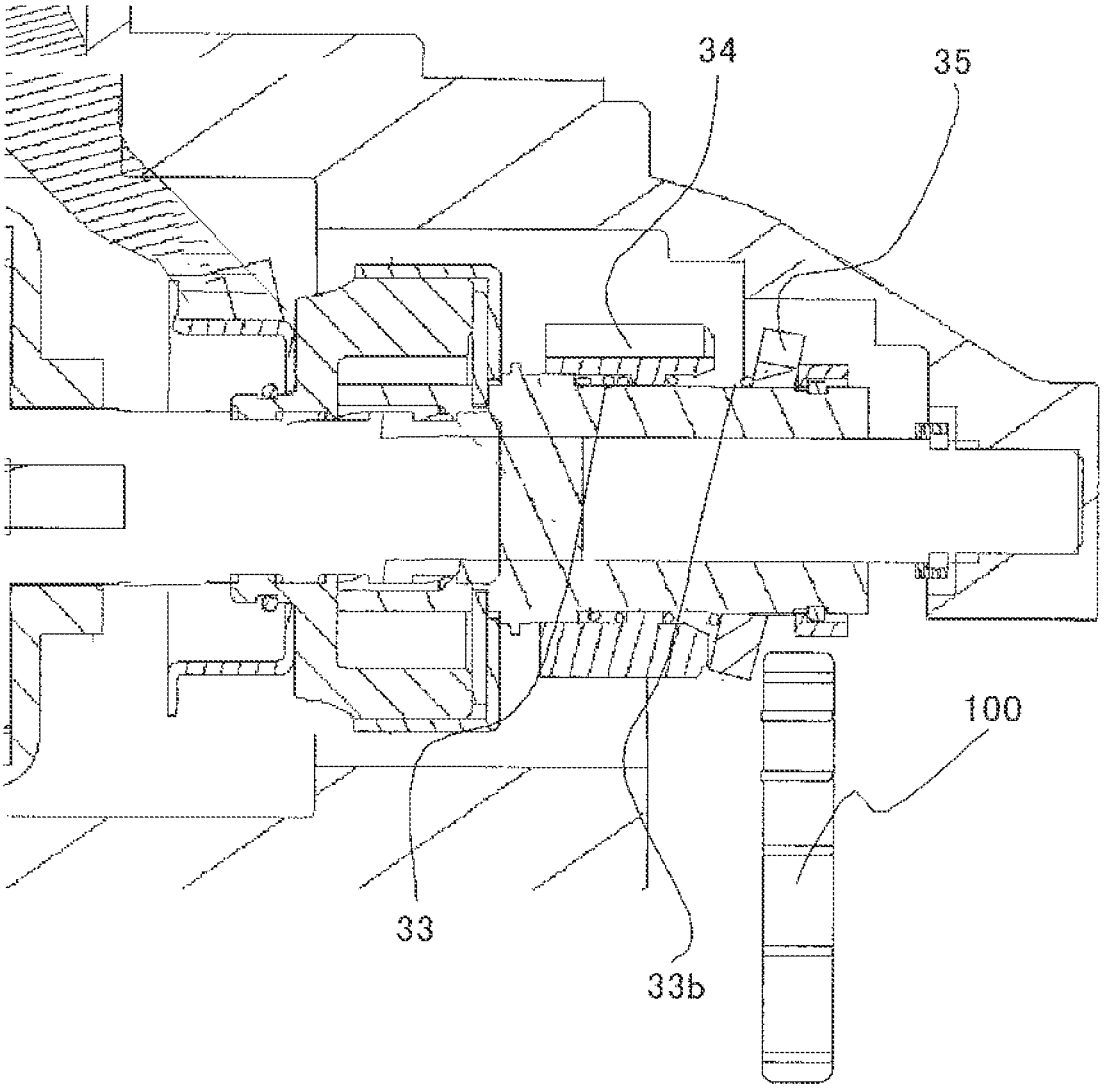
[FIG. 17] A cross sectional view of the starter portion in a state in which the first pinion gear according to the fourth embodiment of the present invention and the ring gear collide with each other and consequently, the first pinion gear is inclined.

FIG. 17 is a cross sectional view of the starter portion in a state in which the first pinion gear 35 according to the fourth embodiment of the present invention and the ring gear 100 collide with each other, and consequently, the first pinion gear 35 is inclined. By the two-part configuration of the coil spring 33 and the coil spring 33*b*, as illustrated in FIG. 17, the first pinion gear 35 comes in contact with the ring gear 100 and the coil spring 33 starts contracting.

On this occasion, the coil spring 33*b* pushes the first pinion gear 35 and the second pinion gear 34 away from each other, and a friction force caused by the contact between the second pinion gear 34 and the first pinion gear 35 can be reduced. On this occasion, it is necessary for the friction force in the rotation direction between the coil spring 33*b* and the first pinion gear 35 to be small. As a result, the backlash in the rotation direction of the first pinion gear 35 is independent of inertia of the second pinion gear 34 and hence the rotation is facilitated. Accordingly, upon the contact, the synchronization is facilitated.

As described above, according to the fourth embodiment, regarding the action mechanism in the rotation direction of the first pinion gear and the second pinion gear, independently of the coil spring pushing the second pinion gear in the pushing direction of the shaft, the coil spring is provided between the first pinion gear and the second pinion gear, and the configuration of the two-part coil springs is provided. As a result, the backlash in the rotation direction of the first pinion gear is independent of the inertia of the second pinion gear and hence the rotation is facilitated. Accordingly, upon the contact, the synchronization is facilitated.

The invention claimed is:

1. An engine starter, comprising:

a starter motor;

a pinion unit coupled to an output-shaft side of the starter motor by means of a spline, for sliding in an axial direction;

a ring gear, which has a push-out mechanism for moving the pinion unit to an engaging position with the ring gear, meshes with a pinion of the pinion unit pushed out by the push-out mechanism, and receives a transmission of a rotation force of the starter motor to thereby start an engine, wherein the pinion unit includes a pinion gear divided in the axial direction into two pinion gears, which are a first pinion gear having a protruded shape for synchronization, for first colliding with the ring gear upon start of meshing with the ring gear, and a second pinion gear for transmitting the rotation force after the meshing, wherein the protruded shape for synchronization of the first pinion gear is constituted by the same number of protrusions as a number of teeth of the second pinion gear, and an area of a vertical cross section in the axial direction of the protrusion is configured to be smaller than a surface area of the second pinion gear, wherein the first pinion gear has a configuration for moving in the axial direction independently of the pinion unit, and wherein the second pinion gear is positioned on a shaft of the pinion unit via the first pinion gear, in the axial direction of the pinion unit, by being pressed in a push-out direction by a spring, and is movable in the axial direction as a result of contraction of the spring.

2. The engine starter according to claim 1, wherein the protruded shape for synchronization of the first pinion gear is configured to have the same number of teeth as the number of teeth of the second pinion gear.

3. The engine starter according to claim 2, wherein, in a specification of the tooth of the first pinion gear, a profile shift, a tooth tip outer diameter, or a pressure angle of the second pinion gear is changed to increase a backlash with respect to the ring gear.

4. The engine starter according to claim 1, wherein the protruded shape for synchronization of the first pinion gear does not have a surface that generates a force of an axial-direction component of the pinion unit in response to a collision in a rotation direction of the ring gear other than a machined surface of a tooth-tip-outer-diameter edge portion and an end surface.

5. The engine starter according to claim 1, wherein the first pinion gear has a backlash in a rotation direction with respect to a shaft of the pinion unit.

6. The engine starter according to claim 5, wherein a range in which the first pinion gear is operable as a result of the backlash in the rotation direction is a range in which, after the second pinion gear meshes with the ring gear, a rotation torque force by the first pinion gear is not transmitted to the ring gear.

7. The engine starter according to claim 6, wherein the range in which the first pinion gear is operable as the result of the backlash in the rotation direction is displaced toward a torque-transmission-direction-surface side with respect to the second pinion gear.

8. The engine starter according to claim 1, wherein the pinion unit has a configuration in which the first pinion gear and the second pinion gear are operable in the axial direction independently of each other.

9. The engine starter according to claim 8, wherein the first pinion gear is axially movable by pushing the spring supporting the second pinion gear.

10. The engine starter according to claim 1, a sum of a friction force in the axial direction of the first pinion gear and the second pinion gear and a load of compressing the spring to a maximum stroke does not exceed a load of pushing out the pinion.

11. The engine starter according to claim 1, wherein the first pinion gear has a backlash in a radial direction with respect to a shaft of the pinion unit.

12. The engine starter according to claim 1, wherein the second pinion gear has a chamfered shape on both sides of a tooth surface edge portion of the first pinion gear side.

13. The engine starter according to claim 12, wherein the chamfered shape is different in shape between an edge on a side of a surface transmitting a rotation torque and an edge on a side of a surface not transmitting the rotation torque.

14. The engine starter according to claim 13, wherein the chamfered shape causes a chamfered end portion to align with an end portion at a location where the end portion of the second pinion gear is exposed, by a backlash of the first pinion gear, to a surface without being hidden by the first pinion gear.

15. The engine starter according to claim 13, wherein the chamfered shape has a chamfered shape along an involute of the tooth on any one of or both of the edge on the side of the surface transmitting the rotation torque and the edge on the side of the surface not transmitting the rotation torque.

16. The engine starter according to claim 1, wherein the second pinion gear includes a protrusion, extending from the second pinion gear toward the first pinion gear in the axial direction, for meshing with the first pinion gear.

17. An engine starter comprising:

a starter motor;

a pinion unit coupled to an output-shaft side of the starter motor by means of a spline, for sliding in an axial direction;

a ring gear, which has a push-out mechanism for moving the pinion unit to an engaging position with the ring gear, meshes with a pinion of the pinion unit pushed out by the push-out mechanism, and receives a transmission of a rotation force of the starter motor to thereby start an engine, wherein the pinion unit includes a pinion gear divided in the axial direction into two pinion gears, which are a first pinion gear having a protruded shape for synchronization, for first colliding with the ring gear upon start of meshing with the ring gear, and a second pinion gear for transmitting the rotation force after the meshing, wherein the protruded shape for synchronization of the first pinion gear is constituted by the same number of protrusions as a number of teeth of the second pinion gear, and an area of a vertical cross section in the axial direction of the protrusion is configured to be smaller than a surface area of the second pinion gear, and wherein the engine starter further comprises a second spring provided between the first pinion gear and the second pinion gear so that a friction force in a rotation direction of the first pinion gear and the second pinion gear is smaller than a friction force in the rotation direction of the first pinion gear and the ring gear.

* * * * *